US006007434A

United States Patent [19]

Baker et al.

[11] Patent Number: 6,007,434

[45] Date of Patent: Dec. 28, 1999

[54] GOLF CLUB

[75] Inventors: Bruce E. Baker; Edward Monett, both of Westfield, N.J.

[73] Assignee: Hustler Golf Company, Westfield, N.J.

[21] Appl. No.: 09/056,123

[22] Filed: Apr. 6, 1998

[51] Int. Cl.[6] ..... A63B 53/04

[52] U.S. Cl. ..... 473/330; 473/331; 473/342

[58] Field of Search ..... 473/330, 331, 473/342, 340

[56] References Cited

U.S. PATENT DOCUMENTS

| | | |
|---|---|---|
| 732,136 | 6/1903 | Taylor . |
| 1,532,545 | 4/1925 | Pedersen . |
| 4,768,787 | 9/1988 | Shira . |
| 5,310,185 | 5/1994 | Viollaz et al. . |
| 5,346,216 | 9/1994 | Aizawa . |
| 5,465,968 | 11/1995 | Aizawa et al. . |
| 5,524,331 | 6/1996 | Pond . |
| 5,688,190 | 11/1997 | Rowland et al. . |
| 5,716,290 | 2/1998 | Baker et al. . |

*Primary Examiner*—Sebastiano Passaniti

[57] ABSTRACT

A club head for a golf club a front surface and a rear surface and defines a front surface recess having a bounding interior wall of arcuate configuration. A member is resident at least in part in the club head recess and defines a front surface for hitting engagement with a golf ball and a rear surface secured to the interior wall of the club head and having the same arcuate configuration as the interior wall of the club head. The member front surface defines pyramid-like projections thereon and has the same arcuate configuration as the member rear surface.

3 Claims, 3 Drawing Sheets

FIG. 1
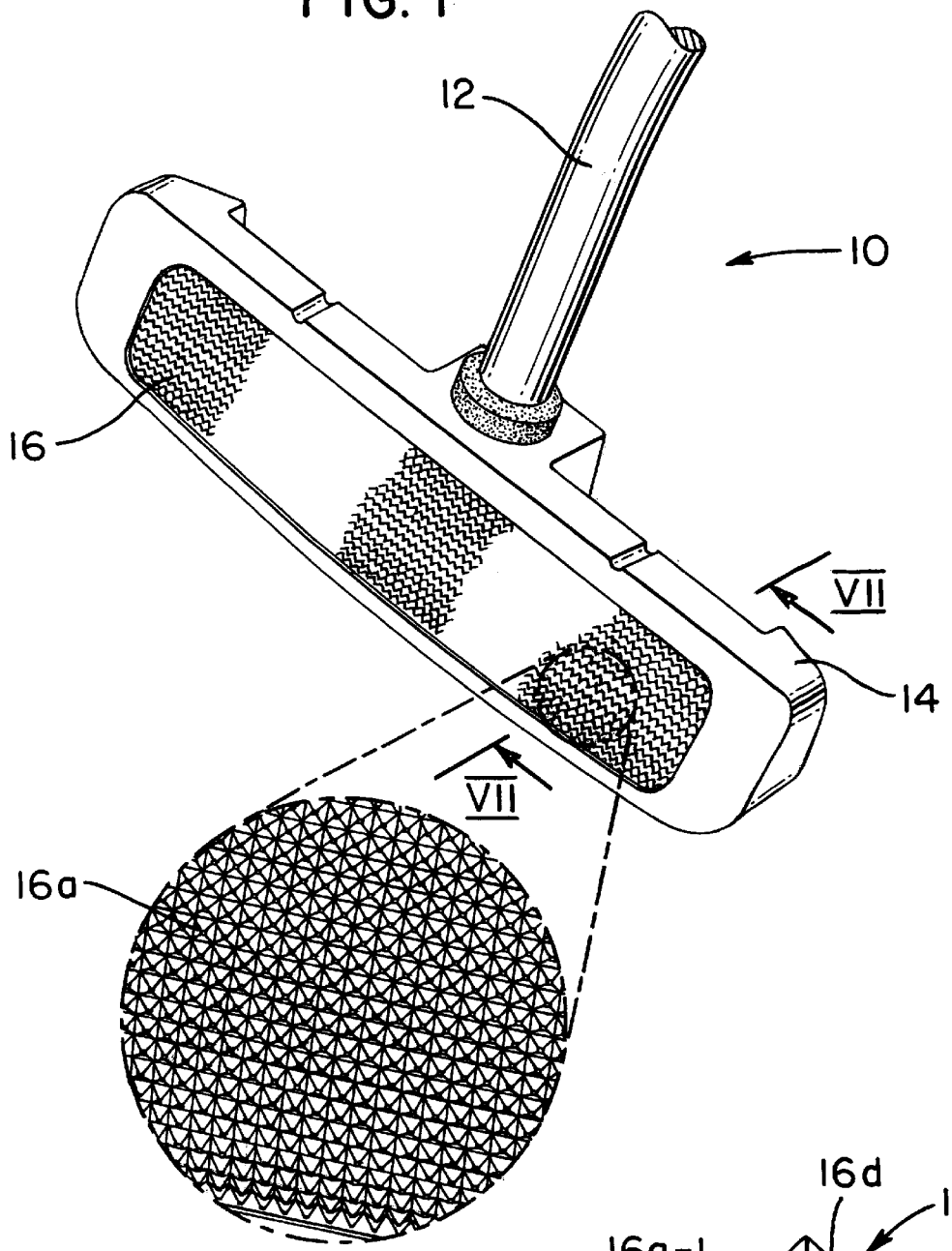
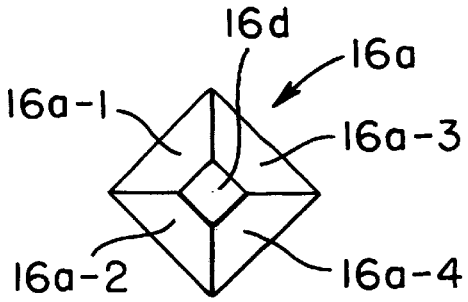
FIG. 2

GOLF CLUB

FIELD OF THE INVENTION

This invention relates generally to improved golf clubs, such as putters, and pertains more particularly to putters for use under adverse course conditions and having top spin facility.

BACKGROUND OF THE INVENTION

In U.S. Pat. No. 5,716,290, applicants introduced a putter having top spin facility afforded by an insert for a golf club head having an arcuate golf ball engaging surface.

Particularly, in the '290 patent, applicants disclosed in combination:

(a) a club head for a golf club, the club head having a front surface and a rear surface; and (b) a member secured to the front surface of the club head and comprised of a material different from material constituting the club head, the member defining a front surface for hitting engagement with a golf ball, the member front surface having an arcuate configuration frontally of the club head front surface, the front surface of the club head adjacent the ends of the member having the same arcuate configuration as the member front surface.

By way of further introduction to the present invention, applicants noted golf club heads having inserts in the prior art as follows, as set forth in the '290 patent.

Another consideration of long-standing in the design of golf clubs is so-called "top spin" facility. Lawton U.S. Pat. No. 1,525,137 advised in 1925 of the value of imparting curvature to a putter ball engaging surface to impart "overspin" to the ball.

The following patents show various top spin surface arrangements: Barr U.S. Pat. No. 3,989,257; Thompson U.S. Pat. No. 4,162,074; Nebbia U.S. Pat. No. 4,902,015; Tucker U.S. Pat. No. 4,964,639; Garcia U.S. Pat. No. 5,303,923 and Sneed U.S. Pat. No. 5,382,019.

Limitation is seen in that all such top spin surfaces are constituted by the same material as the club head.

By way of further indication of prior art practices in the design of golf clubs, note is made of Clark et al. U.S. Pat. No. 4,253,667 and Tucker U.S. Pat. No. 4,964,639. Clark et al. advise of weighting practices, such as forming cavities in club heads and loading the cavities with shot held in place by a matrix. Tucker discloses application of a resilient member, such as a polyurethane rubber, to the front face of a putter to provide "feel" and protection.

SUMMARY OF THE INVENTION

A primary object of the present invention is the provision of improved golf clubs and golf club heads.

Particular objects of the invention are to provide improved top spin imparting structures, particularly when the golfer is faced with a moist green, such as in early morning sessions or rain.

In attaining the foregoing and other objects, the invention provides, in combination: a club head for a golf club, the club head having a front surface and a rear surface and defining a front surface recess having a bounding interior wall of arcuate configuration; and a member resident at least in part in the club head recess and defining a front surface for hitting engagement with a golf ball and a rear surface secured to the interior wall of the club head and having the same arcuate configuration as the interior wall of the club head. The member front surface defines pyramid-like projections thereon and has the same arcuate configuration as the member rear surface. The member is comprised of a material different from material constituting the club head.

A method for use in forming inserts for golf club heads comprises the steps of: mounting a hollow cylinder for working exterior surface of the cylinder; forming a working tool with facility for forming projections on said exterior surface of said cylinder by effecting mutual rotation as between the cylinder and the working tool; and removing elongate segments from the worked cylinder and cutting each removed segment to form the inserts.

In a preferred practice in accordance with the invention, the working tool includes sets of respectively diversely inclined blades which form projections in the form of pyramid-like structures having flat apices.

The invention will be further understood from consideration of the following description of preferred embodiments thereof and from the drawings where like reference numerals identify like parts throughout.

DESCRIPTION OF THE DRAWINGS

FIG. 1 is a partial perspective view of a golf club in accordance with the invention, with a enlarged portion of a club head insert also being shown.

FIG. 2 is greatly enlarged top plan view of one of the projections formed on the club head insert.

DETAILED DESCRIPTION OF THE PREFERRED EMBODIMENT OF THE INVENTION AND PRACTICES THEREOF

Referring to FIG. 1, golf club 10 in accordance with the invention includes shaft 12, golf head 14 and golf head insert 16. On its front surface, insert 16 defines a large number of projections 16*a*.

As is seen in the enlargement shown in FIG. 2, projections 16*a* are preferably in the form of truncated pyramids, having sides faces 16*a*-1, 16*a*-2, 16*a*-3 and 16*a*-4 and flat apex 16*d*.

Figure 3:
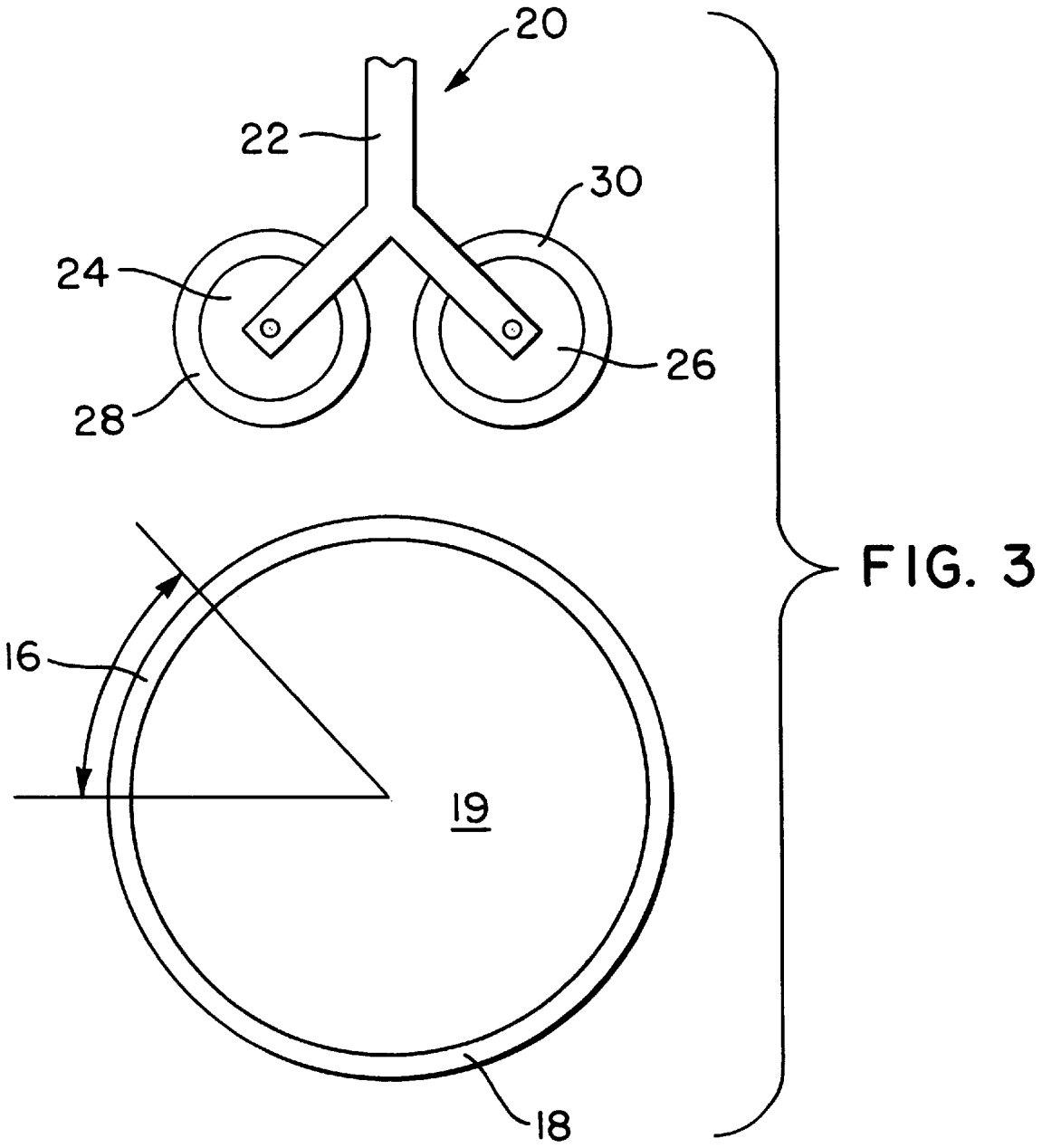
FIG. 3 depicts apparatus for use in forming the club head insert.

Referring to FIG. 3, thin metal cylinder 18 is supported on a cylindrical die 19, the outer diameter of die 19 being essentially equal to the interior diameter of cylinder 18 so as to contiguously back the cylinder in preparation for working the cylinder outer surface.

Knurling tool 20 includes support shaft 22 having yoked bottom rotationally supporting wheels 24 and 26 having respective blade assemblies 28 and 30 at the wheel peripheries.

Figure 4:
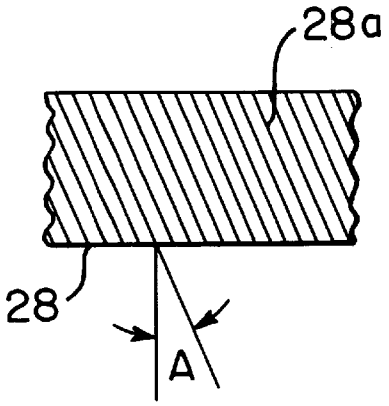
FIG. 4 is a partial view of metal forming member 26 of the FIG. 3 apparatus.

Turning to FIG. 4, the illustrated partial view of blade assembly 28 shows the same to include spaced blades 28*a* at an acute angle A to the vertical.

Figure 5:
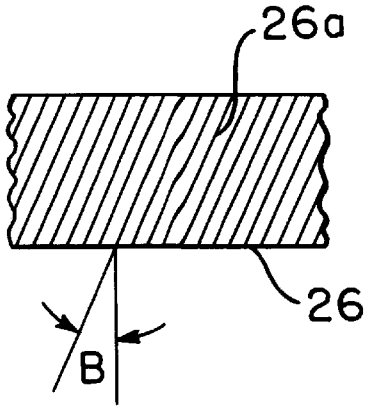
FIG. 5 is a partial view of metal forming member 30 of the FIG. 3 apparatus.

Turning to FIG. 5, the illustrated partial view of blade assembly 26 shows the same to include spaced blades 26*a* at an acute angle B to the vertical.

Figure 6:
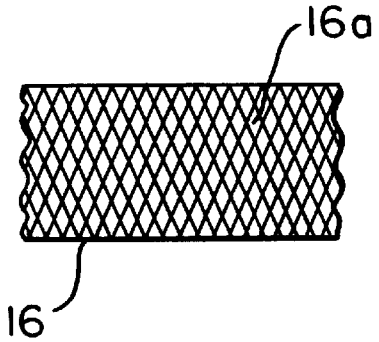
FIG. 6 depicts a metallic member as worked by the FIG. 3 apparatus.

Knurling tool 20 is driven from its FIG. 3 disposition into engagement with the surface of cylinder 18 and is rotated about the cylinder. In the course of the rotation, blades 26*a* make cuts forming sides 16*a*-1 and 16*a*-4 of FIG. 2 and blades 28*a* make cuts forming sides 16*a*-2 and 16*a*-3 of FIG. 2 and blades 28*a*. The blade cuts thus successively criss-cross the cylinder surface, forming the knurl pattern shown in the partial view of FIG. 6. Angles A and B could be selected such that the knurls form a pointed apex. However, in order to provide a front surface for insert 16 which is not unduly rough, applicants select the angles, e.g., at 22.5 degrees respectively left and right to the vertical, leaving flat apex 16*d* of FIG. 2.

Knurling tool 20 is supported for rotation around cylinder 18, as above noted, and may make plural rotations while stopped at a single location and is further supported for indexing to successive locations longitudinally of the cylinder to complete working the entire exterior surface of the cylinder.

In preferred practice, cylinder 18 is selected to be of a length somewhat in excess of the length of insert 16. The circumference of cylinder 18 is selected such that a single cylinder will furnish a plurality of inserts. In the showing of FIG. 3, it will be seen that cylinder 18 will furnish eight inserts, one being shown between the arrows shown in FIG. 3.

Figure 7:
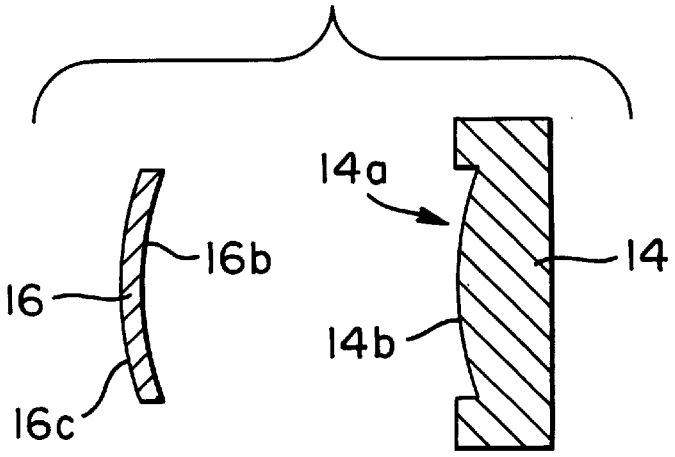
FIG. 7 is an exploded view as would be seen from plane VII—VII of FIG. 1.

Turning to FIG. 7, golf club head defines a recess 14*a* at its front surface of configuration corresponding to insert 16. Thus, radius of curvature of interior bounding surface 14*b* of recess 14*a* is the same as the radius of curvature of the interior surface 16*b* of insert 16. The exterior surface 16*c* of insert 16 has the same arcuate configuration as surface 16*b*. Recess 14*a* has a depth sufficiently less than the thickness of insert 16 such that insert surface 16*c* is disposed outwardly of head 14 so as to be a golf-ball engaging surface.

In making individual inserts, an insert 16, as in its condition in FIG. 3, is cut from cylinder 18 and the cut piece is further cut to conform to the interior boundary of recess 14*a*, so as to be nestable therein.

Cylinder 18 is preferably formed of steel. Head 14 is preferably formed of brass. Individual inserts 16 are preferable nickel plated after the above-discussed cutting operations. The inserts are preferably secured in the club head recesses by an epoxy glue.

In another aspect, the invention will be seen to provide a method for use in making golf club heads, comprising the steps of: forming a recess in a front face of a golf club head with an interior surface having a preselected radius of curvature; selecting a cylindrical member with an interior radius of curvature equal to the preselected radius of curvature; engaging, with exterior surface of the cylindrical member, a forming tool having facility for forming projections on the exterior surface of the cylindrical member; rotating the tool in engagement with the exterior surface of the cylindrical member; cutting a longitudinal segment from the cylindrical member to form an insert having dimensions corresponding with dimensions of the golf head recess; and securing the insert in the golf head recess.

Still further, the invention will be seen to provide a method for use in making golf club heads, comprising the steps of: selecting a cylindrical member with a preselected interior radius of curvature; engaging, with exterior surface of the cylindrical member, a forming tool having facility for forming projections on the exterior surface of the cylindrical member; rotating the tool in engagement with the exterior surface of the cylindrical member; cutting a segment from the cylindrical member to form an insert; forming a recess in a front face of a golf club head with an interior surface having the preselected radius of curvature and having dimensions corresponding with dimensions of the recess; and securing the insert in the golf head recess.

Various changes to the particularly depicted embodiment of the invention may be introduced without departing from the scope of the invention. Thus, while the insert and the golf club head are of dissimilar materials in the disclosed embodiment, the invention of course contemplates the use of a common material for both the insert and the golf club head. Also, changes may be introduced in the projection forming steps above described without departing from the scope of the invention. Accordingly, it is to be appreciated that the particularly disclosed clubs and club heads and methodology are intended in an illustrative, and not in a limiting, sense. The true spirit and scope of the invention is set forth in the ensuing claims.

What is claimed is:

1. In combination:

(a) a club head for a golf club, the club head having a front surface and a rear surface and defining a front surface recess having a bounding interior wall of arcuate configuration; and (b) a member resident at least in part in said club head recess and defining an arcuate front surface for hitting engagement with a golf ball and a rear surface secured to the interior wall of the club head and having the same arcuate configuration as the member front surface and the interior wall of the club head, the member comprising a plurality of pyramids each of which is truncated to have a flattened free end, the member arcuate front surface being defined by the flattened free ends of the pyramids.

2. A golf club comprising a club head having a rear surface and an arcuate front surface for hitting engagement with a golf ball, the club head comprising a plurality of pyramids each of which is truncated to have a flattened free end, the club head arcuate front surface being defined by the flattened free ends of the pyramids.

3. The golf club claimed in claim 2 wherein said club head defines first and second side margins bounding said pyramids and includes a shaft-receiving recess opening into a top surface of said club head centrally of said first and second side margins.

* * * * *